US005235383A

United States Patent [19]

Tada et al.

[11] Patent Number: 5,235,383

[45] Date of Patent: Aug. 10, 1993

[54] PROCESS CARTRIDGE AND IMAGE FORMING APPARATUS USING SAME

[75] Inventors: Hideki Tada; Hisayoshi Kojima; Masanori Yamagata, all of Yokohama; Toshiki Nagase, Hoya; Akira Ito, Tokyo; Mitsugu Inomata, Kawasaki, all of Japan

[73] Assignee: Canon Kabushiki Kaisha, Tokyo, Japan

[21] Appl. No.: 751,965

[22] Filed: Aug. 29, 1991

[30] Foreign Application Priority Data

Aug. 31, 1990 [JP] Japan ..... 2-228413
Sep. 28, 1990 [JP] Japan ..... 2-257131

[51] Int. Cl.[5] ..... G03G 15/00; G03G 21/00

[52] U.S. Cl. ..... 355/200; 355/210; 355/260; 355/326; 355/327

[58] Field of Search ..... 355/200, 210, 211, 326, 355/327, 260

[56] References Cited

U.S. PATENT DOCUMENTS 4,465,357 8/1984 Mugrauer et al. ..... 355/210
4,769,669 9/1988 Watanabe et al. ..... 355/200
4,806,968 2/1989 Watanabe et al. ..... 355/200
4,984,026 1/1991 Nishise et al. ..... 355/271 X
5,038,176 8/1991 Yokoyama et al. ..... 355/326 X

FOREIGN PATENT DOCUMENTS 0283574 11/1989 Japan ..... 355/326
0307774 12/1989 Japan ..... 355/326

*Primary Examiner*—A. T. Grimley
*Assistant Examiner*—Matthew S. Smith
*Attorney, Agent, or Firm*—Fitzpatrick, Cella, Harper & Scinto

[57] ABSTRACT

A process cartridge integrally supports an electrophotographic photosensitive member and a plurality of developing units and removable with respect to an image forming apparatus. The driving force from the image forming apparatus can be selectively transmitted to any one of the developing units and the transmission of the driving force to all of the developing units is blocked during the non-image forming process. Thus, the operability of dismounting of the cartridge from the image forming apparatus is improved.

11 Claims, 15 Drawing Sheets

PROCESS CARTRIDGE AND IMAGE FORMING APPARATUS USING SAME

BACKGROUND OF THE INVENTION

Field of the Invention

The present invention relates to electrophotography, and more particularly it relates to a process cartridge having a plurality of developing means for developing a latent image formed on an electrophotographic photosensitive member, and an image forming apparatus using such cartridge.

Related Background Art

An image forming apparatus wherein a cartridge including a plurality of developing units therein is removably mounted on the apparatus and which utilizes such developing units to develop a latent image formed on an electrophotographic photosensitive member, thereby forming a multi-image on a transfer sheet has been proposed. In such an image forming apparatus, it is necessary to provide a connection mechanism for performing ON/OFF of operations the connection of a plurality of driving force transmitting paths for connecting the plural developing units and driving sources at the apparatus side when the cartridge is mounted on or dismounted from the image forming apparatus, and a changing mechanism for selectively driving the plural developing units. Incidentally, each developing unit comprises a developing roller for applying developer (toner) to the photosensitive member, and a container for containing the developer.

However, in the above image forming apparatus, during the mounting and dismounting of the cartridge, since the engagement and disengagement of the connection mechanism must be effected manually, the mounting and dismounting operation was troublesome. Alternatively, if the engagement and disengagement of the connection mechanism is effected in response to another operation performed upon the mounting and dismounting of the cartridge, it is necessary to provide carry means for carrying out such engagement and disengagement, resulting in the increased cost.

Further, in order to permit the mounting and dismounting of another cartridge different from the above-mentioned cartridge with respect to the image forming apparatus, the same problems will occur as for the driving force transmitting mechanism.

SUMMARY OF THE INVENTION

The present invention aims to eliminate the above-mentioned conventional drawbacks, and has an object to provide a process cartridge and an image forming apparatus, which can facilitate the mounting and dismounting of the cartridge without the engagement and disengagement of a connection mechanism during the mounting and dismounting operation of the cartridge and which are simple and inexpensive.

In order to achieve the above object, the present invention provides a process cartridge adapted to integrally support an electrophotographic photosensitive member and a plurality of developing means and to be removable with respect to a body of an image forming apparatus, and comprising a first driving force transmitting means for receiving a driving force from the image forming apparatus to drive the photosensitive member; developer supplying means provided in the respective developing means and adapted to supply developer to the photosensitive member; second driving force transmitting means provided in the respective developing means to drive the developer supplying means; and a third driving force transmitting means disposed between the first and second driving force transmitting means and adapted to selectively transmit a driving force from the first driving force transmitting means to any one of the developing means.

Further, the present invention also provides an image forming apparatus on which the above-mentioned process cartridge can be mounted.

BRIEF DESCRIPTION OF THE DRAWINGS

FIGS. 5 to 9 are constructural views showing another embodiment of the present invention, where FIG. 5 is an elevational view of an image forming apparatus, FIG. 6 is a side view of a driving force transmitting mechanism.

FIGS. 16 to 18 are constructural views showing another embodiment of the present invention, where FIG. 16 is an elevational view of a multi-color image forming apparatus, FIG. 19 is an elevational sectional view of a multi-color image forming apparatus and FIG. 20 is a bottom view of a developing unit changing mechanism.

DETAILED DESCRIPTION OF THE PREFERRED EMBODIMENTS

The present invention will be explained in connection with embodiments thereof with reference to the accompanying drawings.

Figure 1:
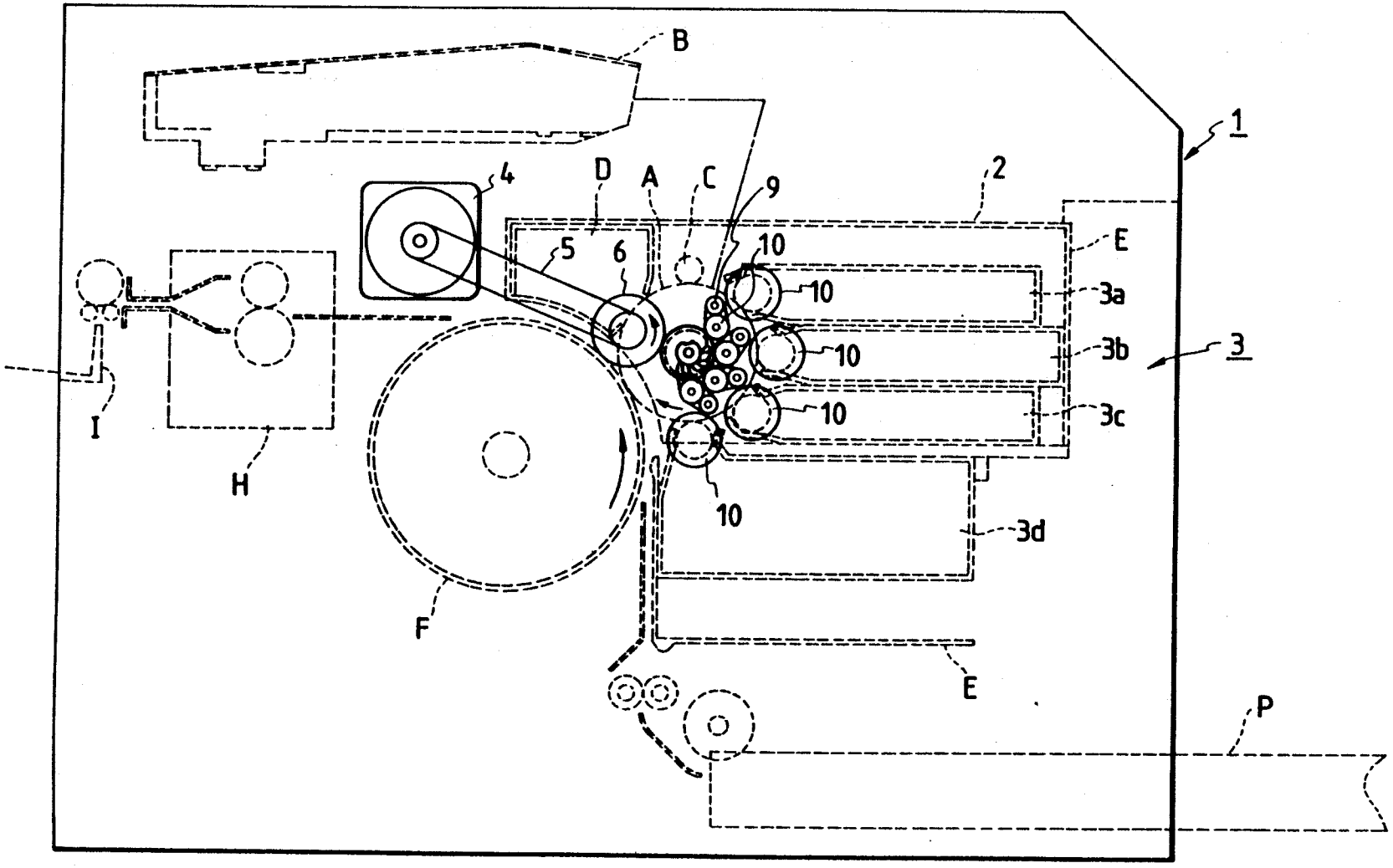
FIG. 1 is an elevational view of a main portion of an image forming apparatus.
Figure 2:
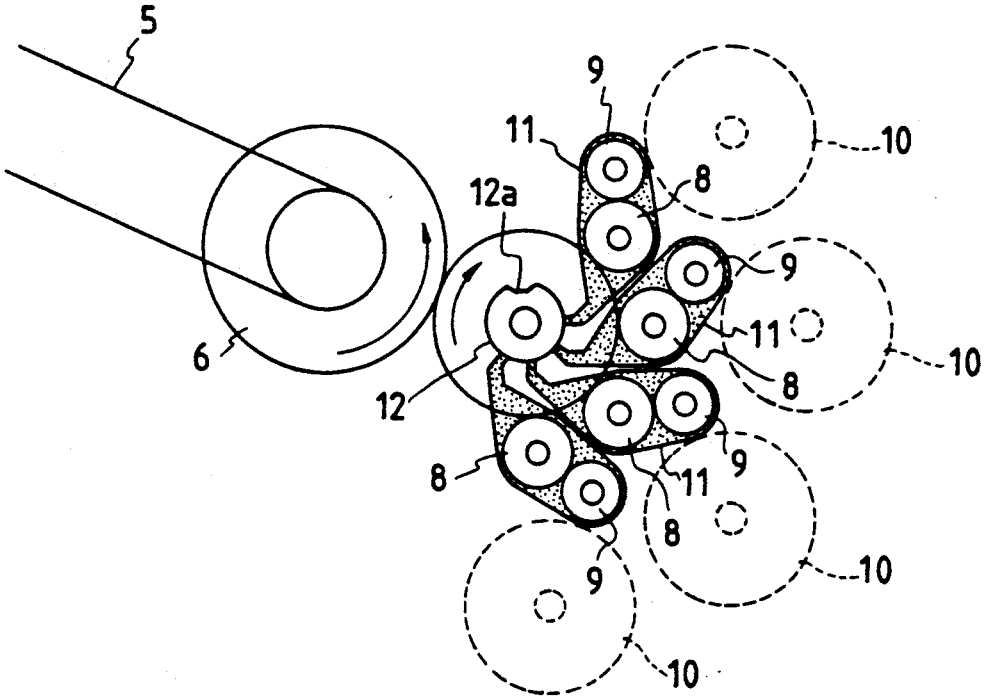
FIGS. 2 and 3 are views for explaining an operation of a driving force transmitting mechanism associated to the present invention.
Figure 3:
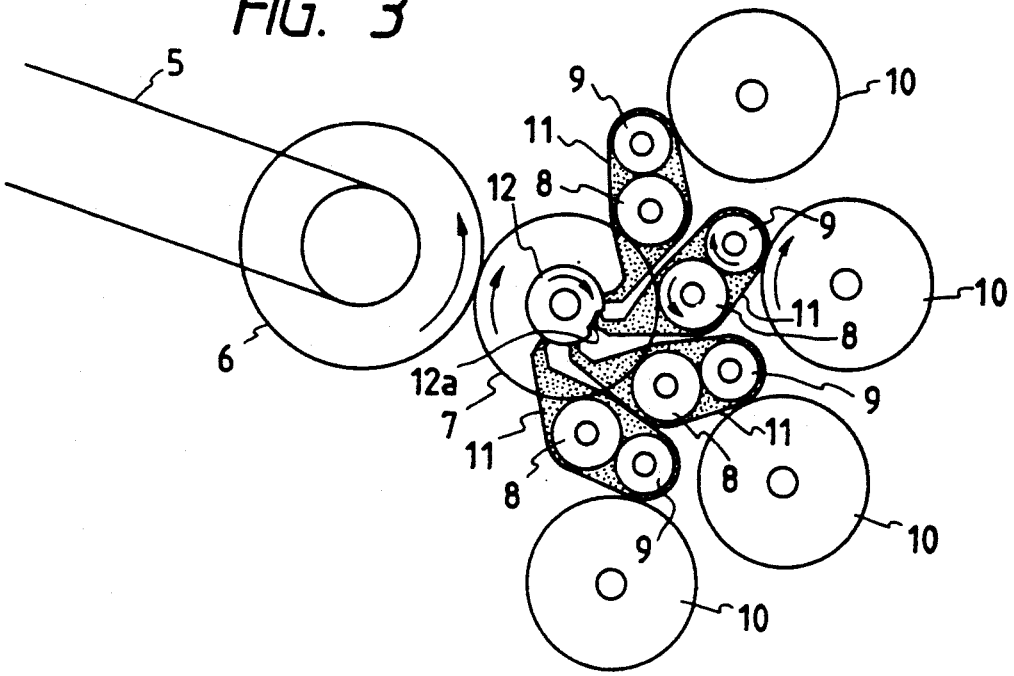
Figure 4:
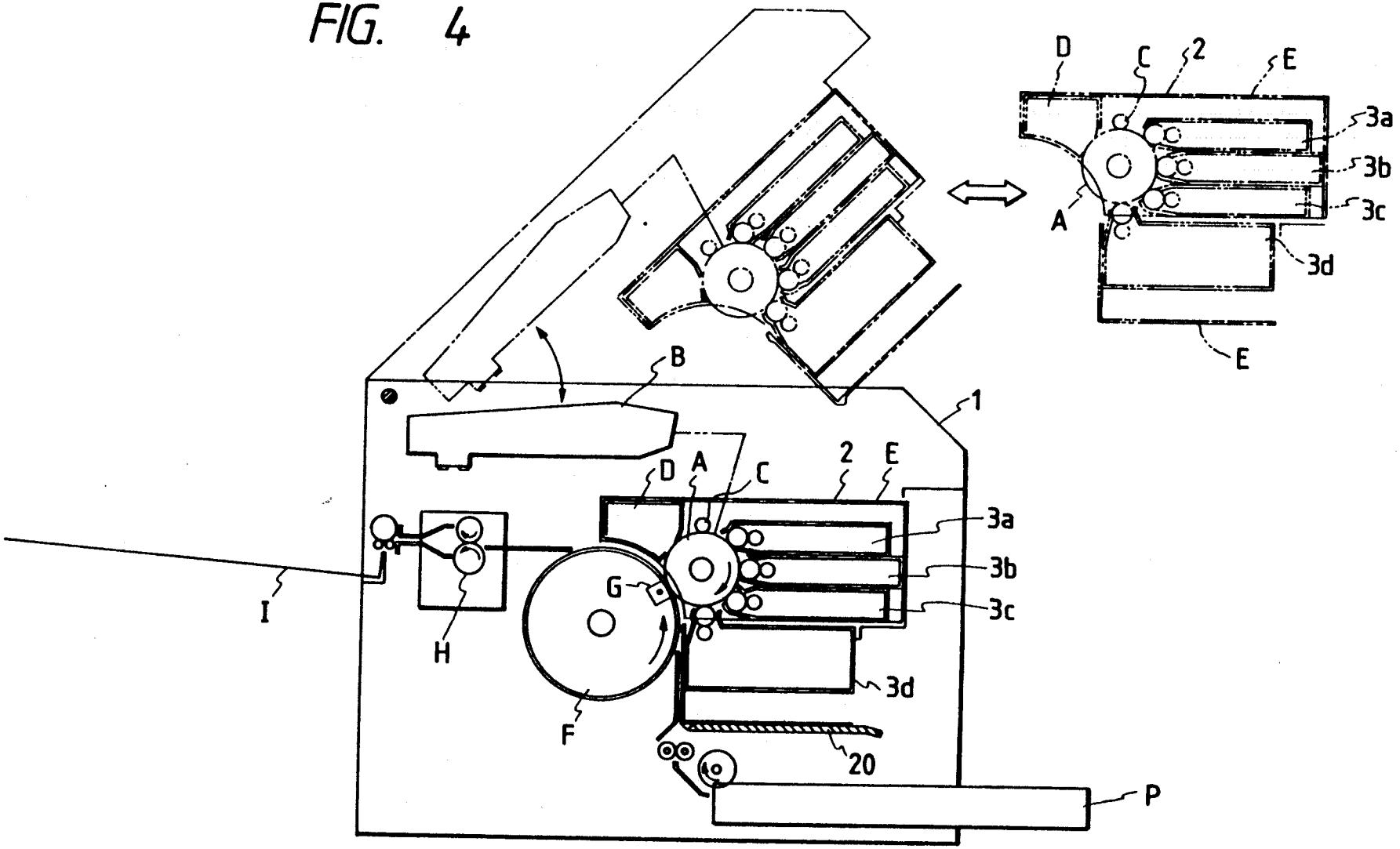
FIG. 4 is an elevational sectional view of the image forming apparatus.

FIG. 1 is an elevational view of a main portion of an image forming apparatus, FIGS. 2 and 3 are views for explaining an operation of a driving force transmitting mechanism associated to the present invention, and FIG. 4 is an elevational sectional view of the image forming apparatus.

A cartridge 2 including a plurality of developing units 3 therein can be removably mounted on a body of an image forming apparatus 1.

The image forming apparatus as shown is embodied as a printer which exposes an electrophotographic photosensitive drum A with a laser beam from an optical scanning means B. The cartridge 2 is constructed by the photosensitive drum A, a charger roller C for uniformly charging the drum, a cleaner D for removing the residual toner from the drum, and a frame E for integrally supporting these elements. A transfer drum F is disposed at a position opposing to the cartridge 2, which transfer drum receives a transfer sheet from a sheet supply cassette P and holds the transfer sheet during the multi-transfer process. A transfer corona discharger G is fixedly disposed within the transfer drum F, which discharger provides a transfer bias for transferring toner images formed on the photosensitive drum onto the transfer sheet sequentially. After the transfer process, the transfer sheet is separated from the transfer drum F and is fed to a fixing heat roller H, where the image is fixed to the sheet. Then, the sheet is ejected onto an ejection ray I.

The developing units 3 comprise a yellow developing unit 3*a* for yellow toner, a magenta developing unit 3*b* for magenta toner, a cyan developing unit 3*c* for cyan toner, and a black developing unit 3*d* for black toner. A full-color image can be formed on the transfer sheet by repeating the development of a latent image with each color and the transferring of the developed image onto the sheet.

The cartridge 2 can be inserted into the image forming apparatus along guide and support rails 20.

As shown in FIGS. 1 to 3, a driving force is transmitted from a driving source (motor) 4 disposed within the image forming apparatus 1 to a gear 6 at an apparatus side via a belt 5. The gears 8 and 9 are mounted on plates 11, and each plate 11 can be pivoted around an axis of the gear 8 so that the gear 9 is biased to be meshed with the corresponding gear 10. Incidentally, the belt 5 and the gears 6, 7, 8 constitute a driving force transmitting mechanism at the apparatus side, and the gears 10 constitute a driving force transmitting mechanism for rotating sleeves in the developing units 3.

On the other hand, a circular cam 12 is disposed so as to be coaxial with the gear 7 and is provided at its peripheral portion with a notch 12*a*. Incidentally, the cam 12, gears 9 and plates 11 constitute a changing mechanism for controlling ON/OFF operations of the connection between the driving force transmitting mechanism at the apparatus side and the driving force transmitting mechanism at the developing unit side.

When the cartridge 2 is mounted and dismounted with respect to the image forming apparatus, the cam 12 is in a condition shown in FIG. 2. In this condition, the ends of all of the plates 11 are abutted against the profile of the cam 12 other than the notch 12*a*, with the result that all of the gears 9 are disengaged from the respective gears 10. Accordingly, in this condition, since the connections of driving force transmitting paths between the developing units 3 of the cartridge 2 and the driving source 4 in the image forming apparatus 1 are released, the cartridge 2 can easily be mounted on or dismounted from the image forming apparatus 1. Incidentally, other than the image forming operation, if the condition shown in FIG. 2 is maintained, it is not needed to release the connection of the driving force transmitting paths each time when the cartridge is mounted on or dismounted from the apparatus.

On the other hand, the developing units 3 are selectively driven in a manner described hereinbelow. That is to say, when the cam 12 is rotated as shown in FIG. 3, the plate 11 engaged by the notch 12*a* of the cam is rotated in a clockwise direction in FIG. 3 around the corresponding gear 8 by a biasing force of a spring (not shown), with the result that only the gear 9 mounted on this plate 11 is engaged by the corresponding gear 10, thus driving the developing unit 3 having this gear 10. Accordingly, the changing mechanism constituted by the gears 9, plates 11 and cam 12 also has a function of selecting the driving force to any developing unit 3. Consequently, any changing mechanism independently provided in the conventional apparatus can be omitted, thus simplifying the driving force transmitting mechanism and making the apparatus inexpensive.

Incidentally, the cam 12 is rotatingly driven by a driving source (not shown), and the drive of the cam is controlled in response to the developing unit 3 to be driven and the condition of the mounting and dismounting of the cartridge 2 so that the cam is stopped at a predetermined angular position.

Figure 5:
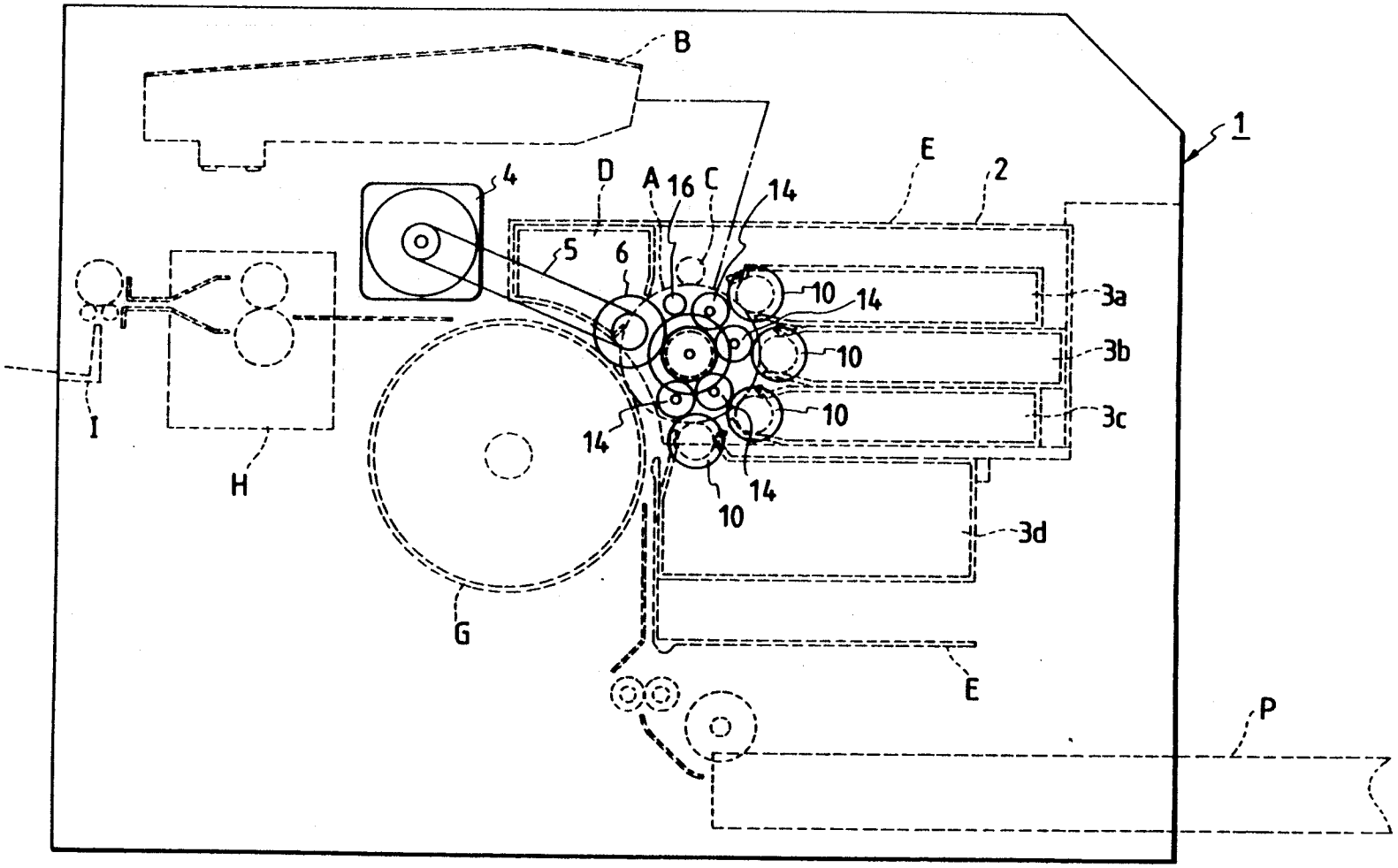

Next, another embodiment of the present invention will be explained with reference to FIGS. 5 to 9. Incidentally, FIG. 5 is an elevational view of an image forming apparatus, FIG. 6 is a side view of a driving force transmitting mechanism, FIGS. 7A and 8A are elevational views of a cam, FIGS. 7B and 8B are views looked at from a direction shown by the arrow X in FIG. 6, and FIGS. 9A and 9B are perspective views of the cam.

In this embodiment, a driving force is transmitted from a driving source (motor) 4 to a gear 6 disposed at an apparatus side via a belt 5, and further to gears 10 of developing units 3 via gears 13, 14 disposed at a cartridge side.

Figure 7A:
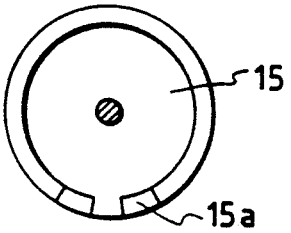
FIGS. 7A and 8A are elevational views of a cam.
Figure 8A:
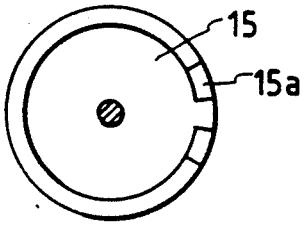
Figure 7B:
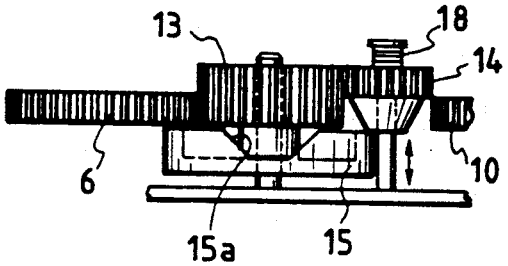
FIGS. 7B and 8B are views looked at from a direction shown by the arrow X in FIG. 6, and FIGS. 9A and 9B are perspective views of the cam.
Figure 8B:
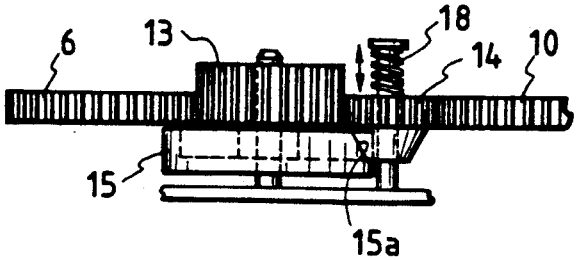
Figure 9A:
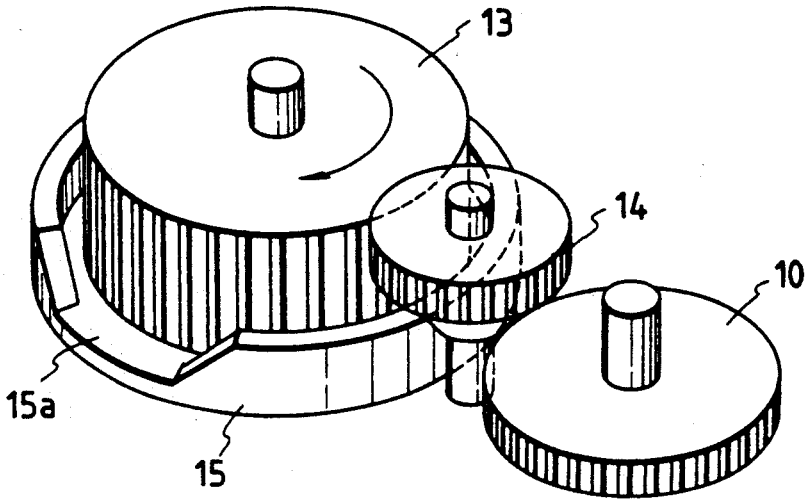
Figure 9B:
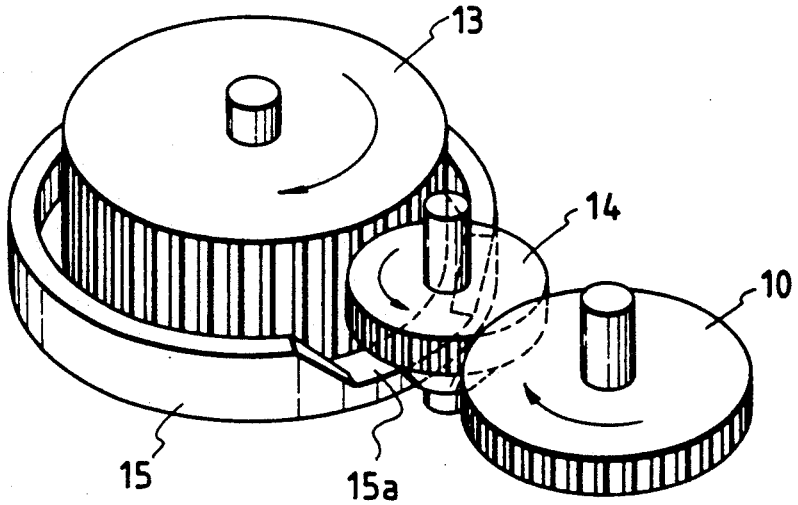

By the way, as shown in FIGS. 7 and 8, the gears 14 are biased toward a cam 15 by means of corresponding springs 18. When the cam 15 having a recess 15*a* is rotated and the recess 15*a* is stopped at a position shown in FIG. 8A, as shown in FIG. 8B, the gear 14 is shifted into the recess 15*a* by means of the biasing force of the corresponding spring 18 so that the gear 14 is meshed with the corresponding gear 10, thus transmitting the driving force to this gear 10. On the other hand, when the recess 15*a* of the cam 15 is stopped at a position shown in FIG. 7A, as shown in FIG. 7B, any gear 14 cannot enter into the recess 15*a*, thus preventing the engagement between the gear 14 and the corresponding gear 10.

Figure 6:
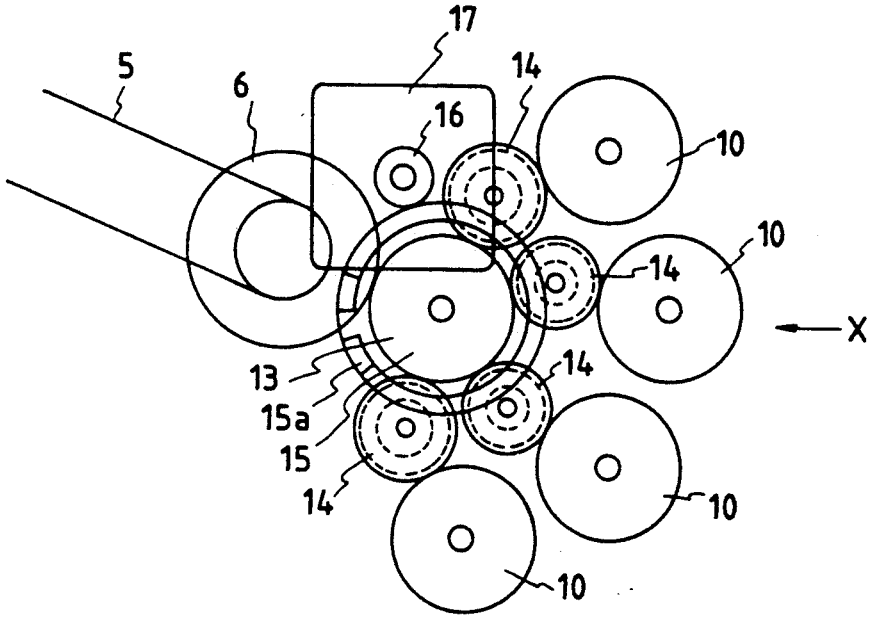

Accordingly, as shown in FIG. 6, other than the image forming process, by maintaining the condition that all of the gears 14 are disengaged from the corresponding gears 10, it is possible to facilitate the mounting and dismounting of the cartridge with respect to the image forming apparatus, similar to the previous embodiment.

Further, also in this embodiment, since the driving force to the developing units can be selected by rotating the cam 15, the driving force transmitting mechanism can be simplified, thus achieving lower cost, similar to the previous embodiment. Incidentally, the cam 15 is rotatingly driven by a driving source 17 (FIG. 6) via a gear 16.

As apparent from the aforementioned explanation, according to this embodiment, there is provided a driving force transmitting device which is arranged in an image forming apparatus wherein a cartridge including a plurality of developing units can be removably mounted within the apparatus and which selectively transmits a driving force to one of the developing units, the driving force transmitting device including a connection mechanism for controlling on/OFF operations of the connection between a driving force transmitting mechanism disposed at a developing unit side and a driving force transmitting mechanism disposed at an apparatus side and being characterized in that the connection mechanism serves to turn OFF the connection between the driving force transmitting mechanisms other than the image forming process and has a function for selecting the driving force transmission to the developing units. Consequently, it is not needed to perform the engagement and disengagement of the connection mechanism during the mounting and dismounting of the cartridge, thus facilitating the mounting and dismounting operations of the cartridge and achieving the cost-down.

In the illustrated embodiments, while an example that the cartridge integrally supports the four developing units, photosensitive drum, charger roller and cleaner was explained, particularly, the black toner developing unit 3d may be of cartridge type, other than the other developing units 3a–3c, in order to afford it a larger capacity, since the black toner is more frequently used than the other toners.

Now, a case where the present invention is applied to the driving system in the aforementioned apparatus will be explained. Incidentally, the members or elements having the same construction and function as those in the previous embodiments will be designated by the same reference numerals as those used in the previous embodiments.

Figure 10:
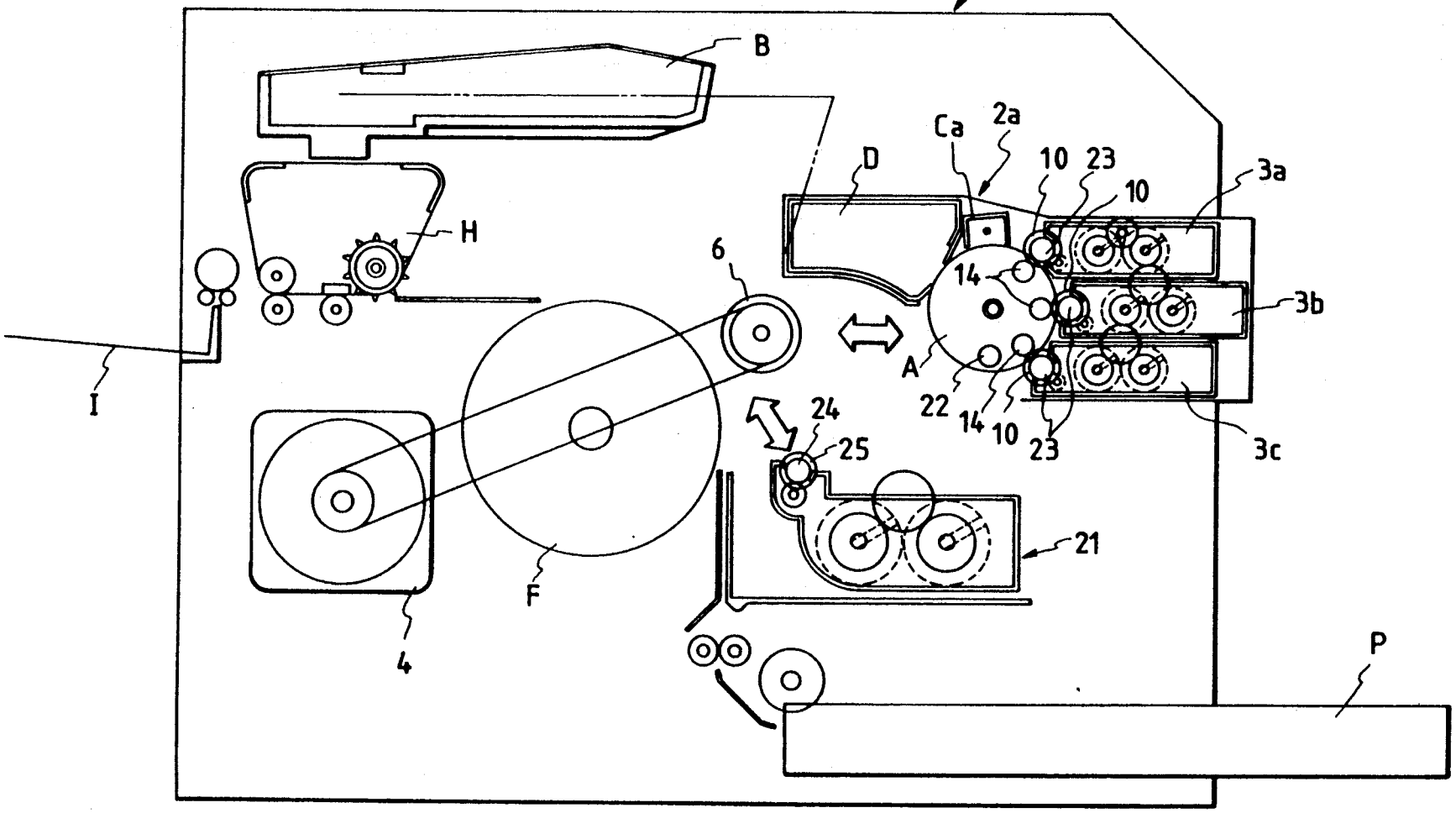
FIGS. 10 and 11 are elevational sectional views of a multi-color image forming apparatus according to a further embodiment of the present invention.
Figure 11:
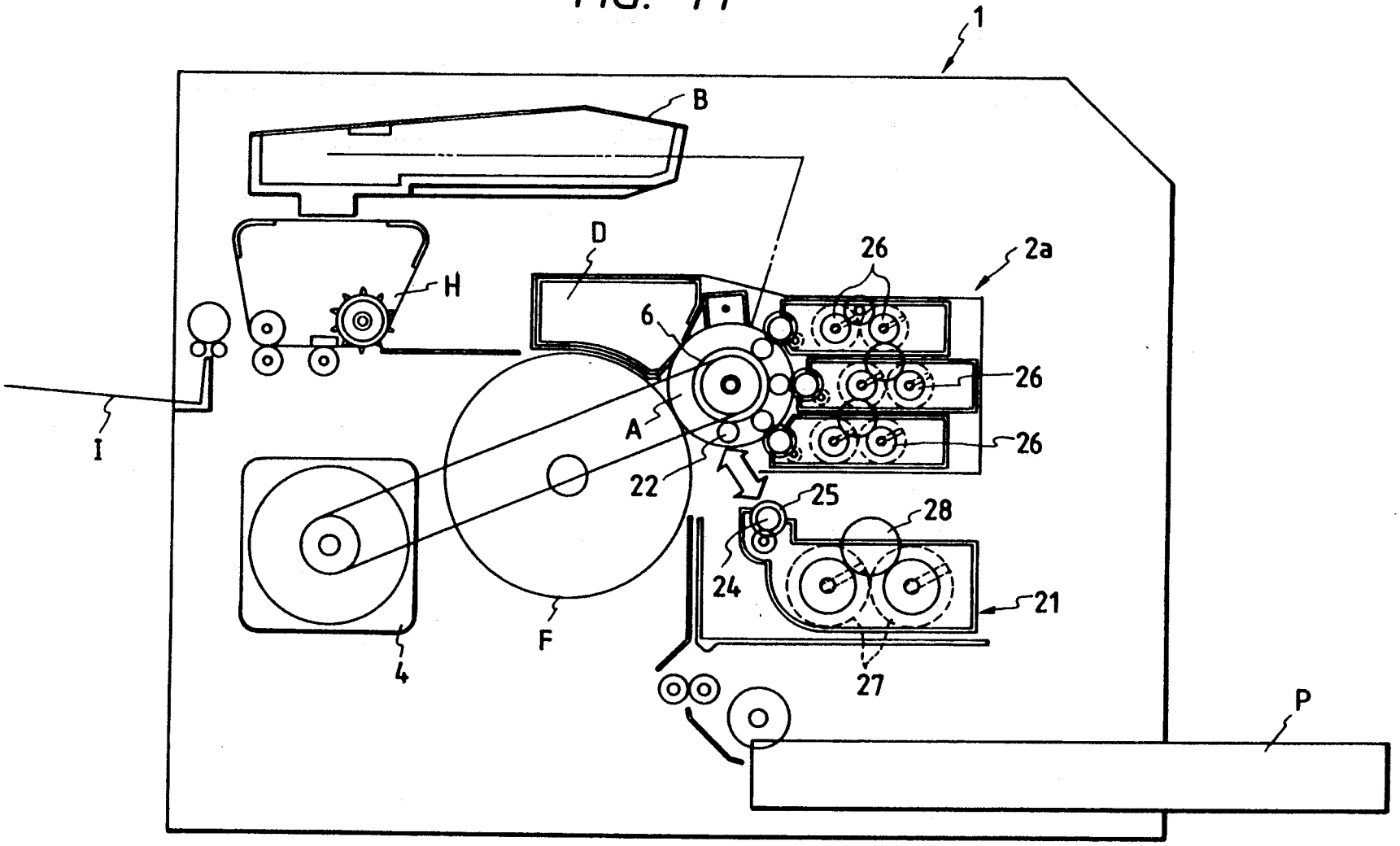

FIGS. 10 and 11 are elevational sectional view of a multi-color image forming apparatus. In this apparatus, a main cartridge 2a at a photosensitive drum side and an auxiliary cartridge 21 at a black toner developing unit side are removable with respect to the image forming apparatus 1.

The main cartridge 2a includes therein a photosensitive drum A, a charging corona discharger Ca, and a plurality of developing units 3a–3c for yellow, magenta and cyan toners, respectively; and the auxiliary cartridge 21 comprises a single developing unit for black toner.

Further, a driving source 4 disposed within the image forming apparatus 1 serves to transmit a driving force to a gear 6 disposed within the image forming apparatus 1. Incidentally, the gear 6 is positioned so as to be coaxial with the photosensitive drum A in the cartridge 2a when the latter is mounted within the image forming apparatus.

The main cartridge 2a includes drive gears 14, 22. The gear 14 serve to transmit driving forces to sleeves (developer bearing members) 23 of the developing units 3a–3c, respectively, via gears 10; whereas, the gear 22 serves to transmit a driving force to a sleeve 24 of the auxiliary cartridge 21, via a gear 25. Incidentally, by turning ON/OFF electromagnetic clutches (not shown) associated with the gears 14, 22, respectively, the gears 14, 22 can selectively drive the sleeves 23, 24.

As shown in FIG. 11, when the main cartridge 2a is mounted within the image forming apparatus 1, the gears 14 meshed with the gears 10 are engaged by the gear 6 so that the driving force is transmitted from the gear 6 to the gears 14. In this condition, when the auxiliary cartridge 21 is inserted from a direction (with respect to the main cartridge 2a) shown by the arrow in FIG. 11 to engage the gear 25 of the sleeve 24 by the gear 22, the sleeve 24 can be rotatingly driven by the driving force from the gear 22.

As mentioned above, in this embodiment, since the transmission of the driving force to the auxiliary cartridge 21 is effected via the main cartridge 2a, the auxiliary cartridge 21 may merely be positioned only with respect to the main cartridge 2a. As a result, the positioning accuracy of the sleeve 24 of the auxiliary cartridge 21 regarding the photosensitive drum A of the main cartridge 2a is improved, and the mounting and dismounting mechanism for the auxiliary cartridge 21 is simplified, thus improving the operability. Further, a drive connecting mechanism for connecting the gear 6 at the apparatus side and the main cartridge 2a is also simplified.

The developing units 3a–3c in the main cartridge 2a have developer agitating members 26, respectively, which are intermittently rotated by the driving force to agitate the developer in the units. Further, the auxiliary cartridge 21 is also provided with developer agitating members 27 which are rotatingly driven by the driving force from the main cartridge 2a via a gear 28.

Figure 12:
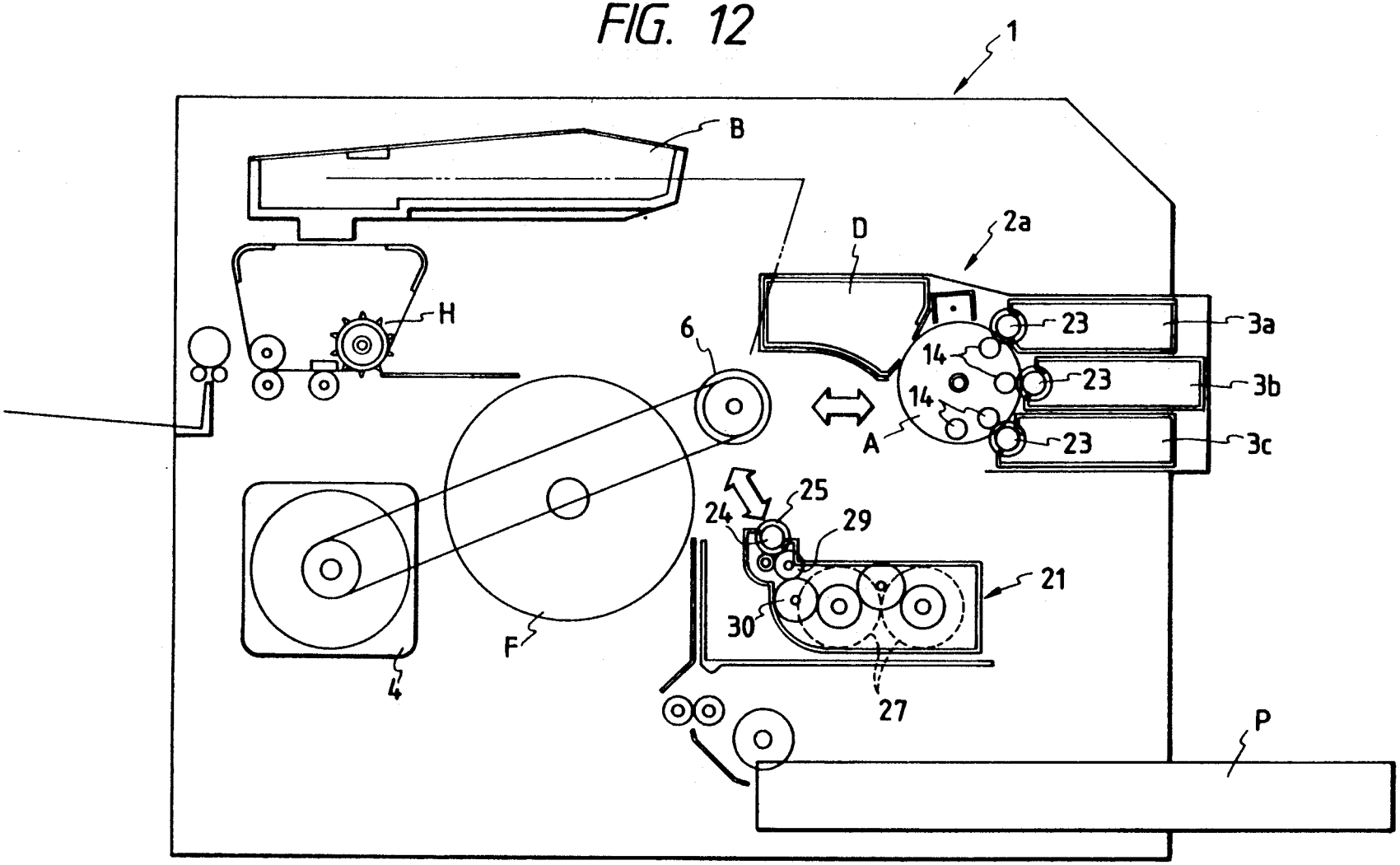
FIGS. 12 and 13 are elevational sectional views of a multi-color image forming apparatus according to a still further embodiment of the present invention.
Figure 13:
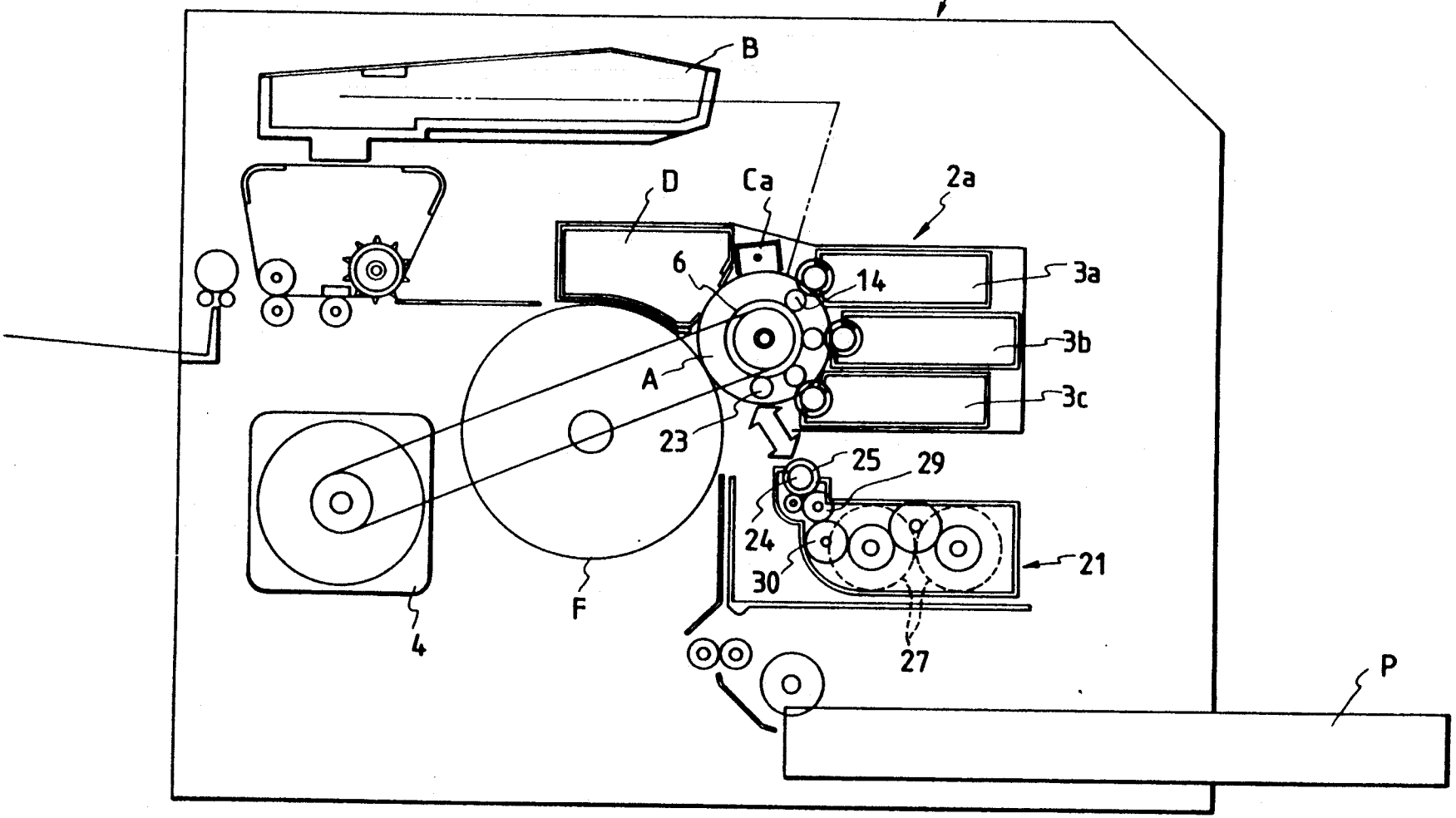

Next, another embodiment using such two cartridges will be explained with reference to FIGS. 12 and 13. In this embodiment, the developer agitating members 27 of the auxiliary cartridge 21 receive the driving force from the sleeve gear 25 via gears 29, 30. With this arrangement, only by positioning the sleeve 24 of the auxiliary cartridge 21 with respect to the photosensitive drum A of the main cartridge 2a, the connections for the drive can be effected simultaneously.

Figure 14:
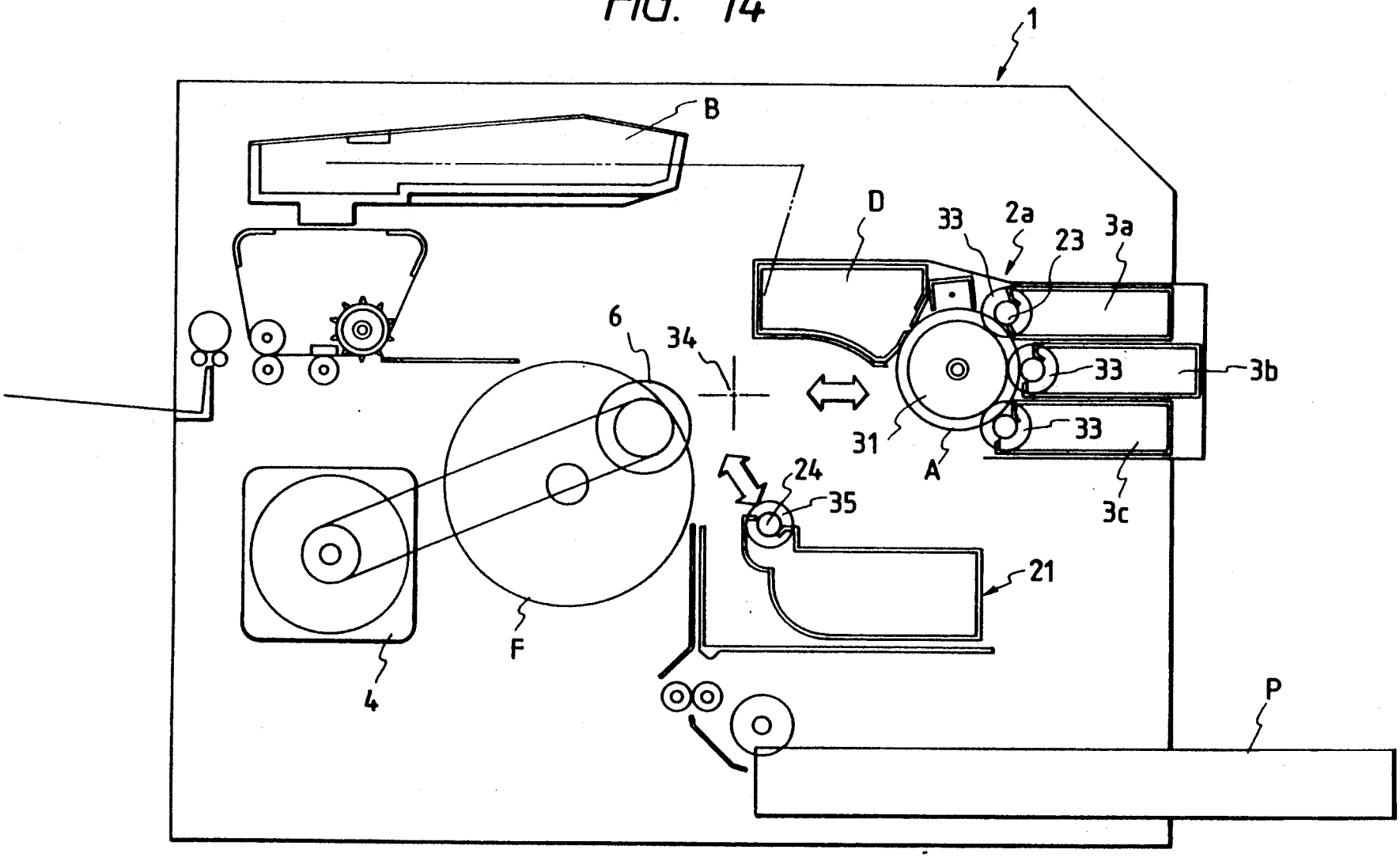
FIGS. 14 and 15 are elevational sectional views of a multi-color image forming apparatus according to a further embodiment of the present invention.
Figure 15:
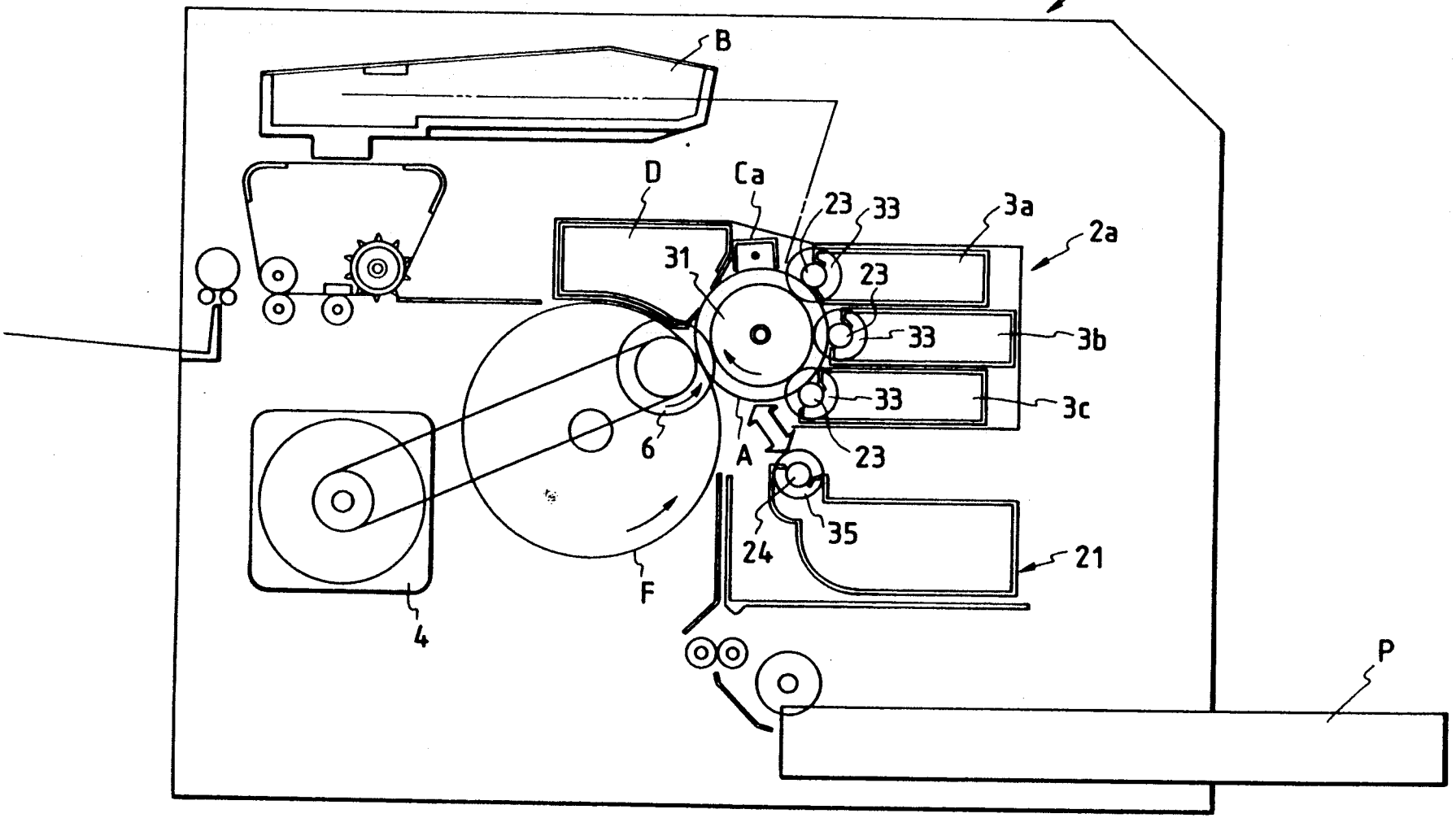

A further embodiment is shown in FIGS. 14 and 15.

In this embodiment, a gear 31 is disposed so as to be coaxial with the photosensitive drum A in the main cartridge 2a, which gear 31 is meshed with gears 33 for the sleeves 23 of the developing units 3a–3c. Incidentally, these drive gears 33 have electromagnetic clutches (not shown), respectively. By selectively turning the electromagnetic clutches ON/OFF, the developing units 3a–3c are selectively driven.

As shown in FIG. 15, when the main cartridge 2a is mounted within the image forming apparatus 1 at a cartridge holding central position 34 (FIG. 14), the driving force from the driving source 4 is transmitted to the gear 31 at the cartridge side via the gear 6, so that one of the sleeves 23 can be selectively driven.

On the other hand, a sleeve drive gear 35 is fixedly mounted on a sleeve shaft of the sleeve 24 of the auxiliary cartridge 21 and has an electromagnetic clutch (not shown). When the auxiliary cartridge 21 is positioned with respect to the photosensitive drum A in the main cartridge 2a, the sleeve gear 35 is engaged by the gear 31 of the main cartridge 2a, thus permitting the drive of the auxiliary cartridge 21.

Figure 16:
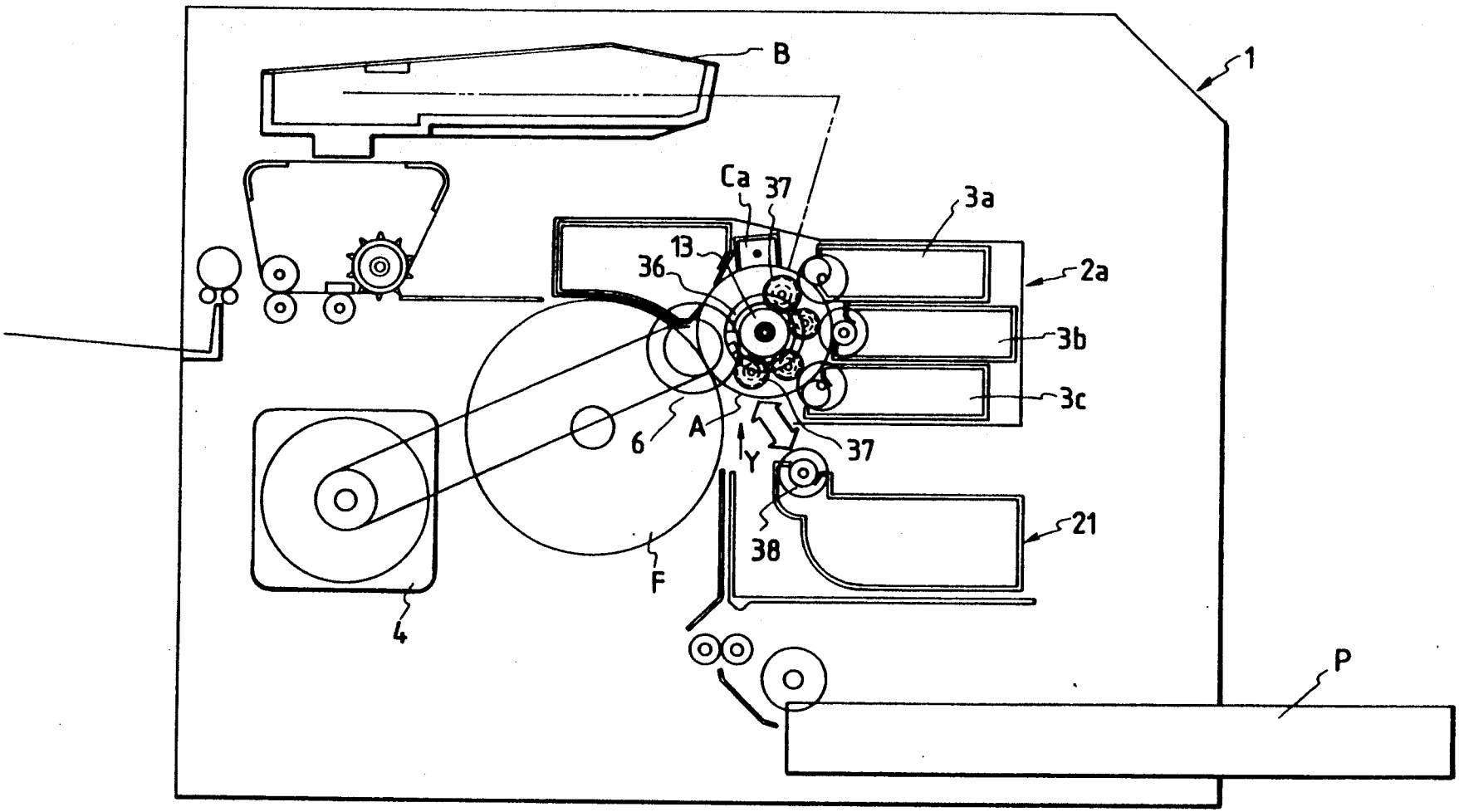

A still further embodiment is shown in FIGS. 16 to 18.

Figure 17A:
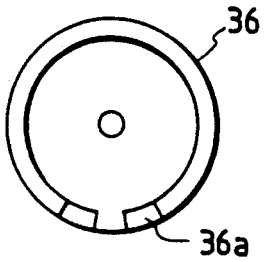
FIGS. 17A and 18A are elevational views of a cam.
Figure 18A:
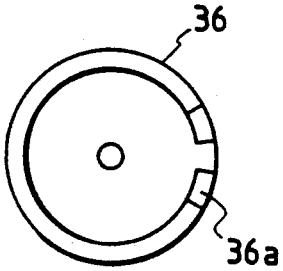
Figure 17B:
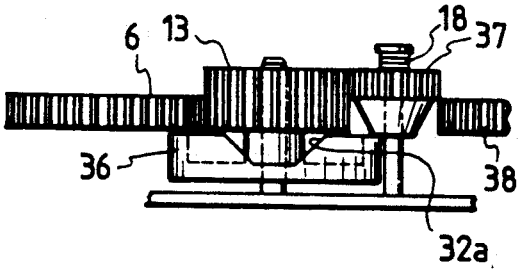
FIGS. 17B and 18B are bottom views of a developing unit changing mechanism (looked at from a direction shown by the arrow Y in FIG. 16)
Figure 18B:
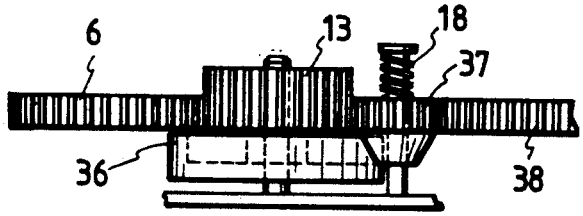

In this embodiment, the drive changing mechanism for the developing units is provided in the main cartridge 2a, as shown in FIGS. 16 and 18. Incidentally, FIGS. 17A and 18A are elevational views of a cam 26, and FIGS. 17B and 18B are bottom views of the developing unit changing mechanism (looked at from a direction shown by the arrow Y in FIG. 16).

The developing unit changing mechanism includes a cam 36 of the same type as that illustrated so as to be FIG. 9, which cam is disposed in coaxial with the photosensitive drum A. The cam 36 having a recess 36a operates in the same manner as the aforementioned cam 15. One of changing gears 37 arranged at the main cartridge side is selectively engaged by the recess 36a.

When the auxiliary cartridge 21 is positioned with respect to the main cartridge 2a, as shown in FIGS. 17B and 18B, a transmission gear 38 of the auxiliary cartridge 21 is shifted to a position where the transmission gear can be meshed with one of the gears 37. In this condition, when the cam recess 36a is positioned as shown in FIG. 17A, none of the changing gears 37 cannot enter into the cam recess 36a as shown in FIG. 17B, thus keeping the disconnected condition between the changing gears 37 and the transmission gear 38 of the auxiliary cartridge 21, so that the driving force is not transmitted to the transmission gear 38. As a result, the auxiliary cartridge 21 is not driven in this condition.

On the other hand, when the cam recess 36a is rotated to a position shown in FIG. 18A by means of a driving source (not shown), as shown in FIG. 18B, one of the changing gears 37 is shifted into the cam recess 36a to be engaged by the transmission gear 38, with the result that the driving force of the driving source 4 (FIG. 16) is transmitted to the transmission gear 39 via the gears 6, 13, 37, thus driving the auxiliary cartridge 21 for the developing operation.

Figure 20:
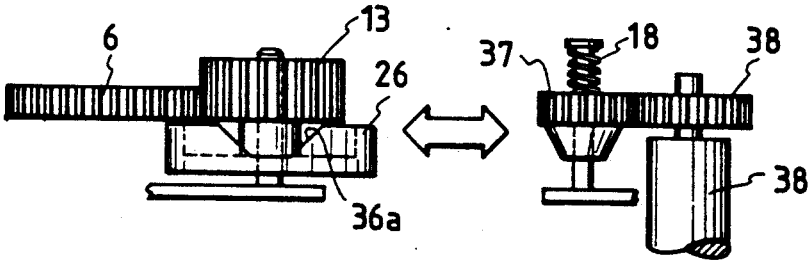
FIGS. 19 and 20 are views showing another embodiment of the present invention, where
Figure 19:
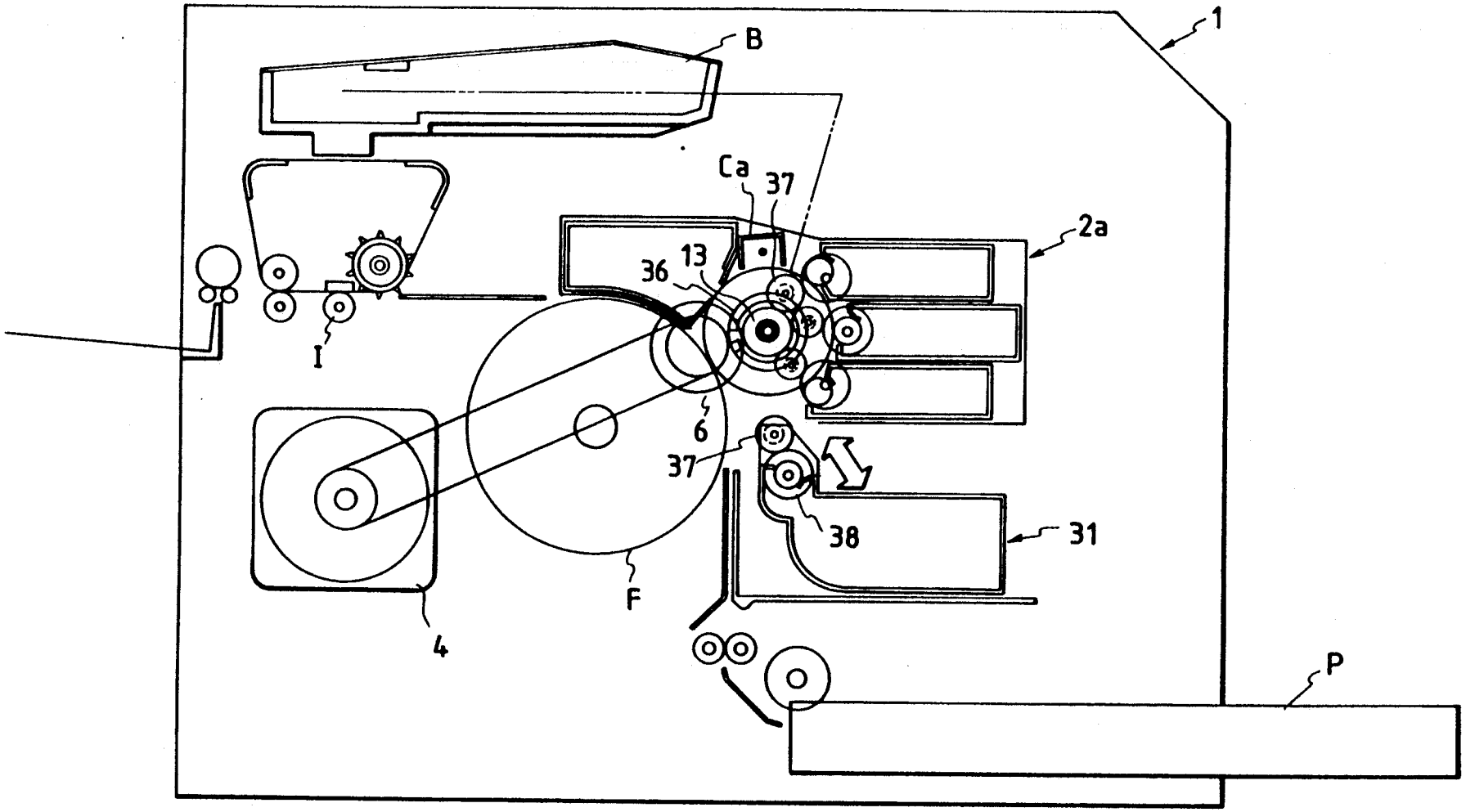

The other embodiment of the present invention is shown in FIGS. 19 and 20. In this embodiment, the changing gear 37 associated with the transmission gear 38 in the previous embodiment is arranged at the auxiliary cartridge side. As shown in FIG. 20, when this changing gear 37 is engaged by the cam recess 36a of the cam 36 arranged at the main cartridge side, the driving force is transmitted to the transmission gear 38 of the auxiliary cartridge 21. That is to say, similar to the previous embodiment, the driving force of the driving source 4 (FIG. 19) is transmitted to the transmission gear 38 via the gears 6, 13 and 37, thus driving the auxiliary cartridge 21.

As apparent from the aforementioned explanations, according to the embodiments shown in FIGS. 10 to 20, there is provided a drive mechanism used with an image forming apparatus wherein a main cartridge including at least a photosensitive member and developing units and an auxiliary cartridge including at least one developing unit are removable with respect to a body of the image forming apparatus, and having a driving source arranged at an apparatus side and adapted to drive the main cartridge and the auxiliary cartridge, the mechanism is characterized in that the drive connection is effected between the image forming apparatus and the main cartridge and the drive transmission to the auxiliary cartridge is effected via the main cartridge. As a result, the positioning accuracy of the auxiliary cartridge regarding the main cartridge can be improved, the auxiliary cartridge can be simplified, and the drive connecting mechanism between the main cartridge and the image forming apparatus can also be simplified.

Meanwhile, drive force exerted from the gear 7 can be utilized to rotate also the drum A adding to drive the gears 8 of developing devices.

What is claimed is:

1. An image forming apparatus, comprising:

mounting means for mounting a cartridge onto the image forming apparatus, said cartridge including at least one developing means including a moving member for supplying developing agent to an image bearing body, and a first driving force transmitting member for transmitting a driving force to said moving member;

a second driving force transmitting member for transmitting driving force to said first driving force transmitting member, said second driving force transmitting member being free of said first driving force transmitting member when said cartridge is initially mounted onto said image forming apparatus and being adapted to subsequently contact said first driving force transmitting member; and a driving source for driving said second driving force transmitting member.

2. An image forming apparatus according to claim 1, wherein said cartridge includes said image bearing body.

3. An image forming apparatus according to claim 2, further comprising charging means for charging said image bearing body and cleaning means for cleaning residual material from said image bearing body.

4. An image forming apparatus according to claim 1, further comprising a second developing means removably mounted onto said image forming apparatus.

5. An image forming apparatus according to claim 4, wherein said second developing means includes a black developing agent.

6. An image forming apparatus according to claim 1, further comprising engaging means for engaging said first and second driving force transmitting members, when said cartridge is mounted onto said mounting means for image forming.

7. An image forming apparatus according to claim 1, 4, wherein, said cartridge has a plurality of developing means.

8. An image forming apparatus according to claim 10, wherein each of said plurality of developing means includes a developing agent of a different color.

9. An image forming apparatus according to claim 8, wherein the colors of said developing agents are yellow, magenta, and cyan.

10. An image forming apparatus according to claim 7, wherein said engaging means can selectively engage said first driving force transmitting member corresponding to said moving member of a respective developing means with said second driving force transmitting member corresponding to each of said first driving force transmitting member of a respective developing means.

11. An image forming apparatus according to claim 1, wherein said moving member is a developing roller capable of bearing a developing agent.

* * * * *

UNITED STATES PATENT AND TRADEMARK OFFICE

CERTIFICATE OF CORRECTION

PATENT NO. 5,235,383

DATED August 10, 1993

INVENTOR(S) Hideki Tada, et al.

It is certified that error appears in the above-indentified patent and that said Letters Patent is hereby corrected as shown below:

Title page,

AT [56] References Cited - at FOREIGN PATENT DOCUMENTS:

Insert --193170 9/1986 Eur. Pat. Off.
370455 5/1990 Eur. Pat. Off.
371758 6/1990 Eur. Pat. Off.
376617 7/1990 Eur. Pat. Off.--.

COLUMN 1:

line 23, "of operations" should read --operations of--; and
line 37, "was" should read --is--.

COLUMN 2:

line 21, "constructural" should read --constructional--; and
line 39, "constructural" should read --constructional--.

COLUMN 5:

line 13, "the cost.-" should read --lower cost--;
line 14, "down." should be deleted; and
line 51, "serve" should read --serves--.

UNITED STATES PATENT AND TRADEMARK OFFICE

CERTIFICATE OF CORRECTION

PATENT NO. 5,235,383

DATED August 10, 1993

INVENTOR(S): Hideki Tada, et al.

It is certified that error appears in the above-indentified patent and that said Letters Patent is hereby corrected as shown below:

COLUMN 6:

line 63, "so as to be" should read --in--; and
line 64, "in" should read --so as to be--.

COLUMN 7:

line 57, "adding to" should read --also to--.

COLUMN 8:

line 38, "to claim 1," should read --to either claim 1,--;
line 39, "4, wherein said" should read --4, or 9, wherein said--;

Signed and Sealed this

Seventh Day of June, 1994

Bruce Lehman

BRUCE LEHMAN

*Commissioner of Patents and Trademarks*

*Attest:*

*Attesting Officer*